US006572368B1

(12) United States Patent
Tenzek et al.

(10) Patent No.: US 6,572,368 B1
(45) Date of Patent: Jun. 3, 2003

(54) METHOD AND APPARATUS FOR COOLING A FURNACE

(75) Inventors: Anthony M. Tenzek, Hanoverton, OH (US); Jeffrey P. Deeter, Mineral Ridge, OH (US); David A. Lazor, Hubbard, OH (US)

(73) Assignee: Lectrotherm, Inc., N. Canton, OH (US)

( * ) Notice: Subject to any disclaimer, the term of this patent is extended or adjusted under 35 U.S.C. 154(b) by 0 days.

(21) Appl. No.: 10/224,774

(22) Filed: Aug. 20, 2002

(51) Int. Cl.[7] ..... F27D 13/00
(52) U.S. Cl. ..... 432/4; 432/18; 432/205
(58) Field of Search ..... 432/4, 77, 81, 432/233, 205, 206, 207, 256, 18

(56) References Cited

U.S. PATENT DOCUMENTS 4,925,388 A * 5/1990 Iseki et al. ..... 432/77
6,328,561 B1 * 12/2001 Hasper et al. ..... 432/238

* cited by examiner

*Primary Examiner*—Jiping Lu
(74) *Attorney, Agent, or Firm*—Sand & Sebolt

(57) ABSTRACT

A method and apparatus for accelerated cooling of a furnace such as a furnace containing a susceptor. Cooling gases are split whereby a first percentage are provided to cool the furnace while a second percentage are provided to assist in cooling the heated cooling gases after cooling the furnace, whereby the percentages are changed throughout the process. The system further provides for unique cooling flow arrangement in the furnace which promotes maximum heat transfer through swirling.

20 Claims, 6 Drawing Sheets

METHOD AND APPARATUS FOR COOLING A FURNACE

BACKGROUND OF THE INVENTION

1. Technical Field

This invention relates to furnaces and the cooling thereof. More particularly, this invention relates to an accelerated gas cooling system for a furnace or like heating system. Specifically, the invention is a method and apparatus for accelerated cooling of a heating system such as a susceptor heating system.

2. Background Information

It is well known that furnaces or other heating systems are used to heat materials and parts to very high temperatures for a variety of reasons such as heat treating, annealing, curing, baking on coatings, masking, tempering, purification, application of graphite, or hardening. Typically, materials or parts are placed in the furnace that is sealed from the atmosphere or under positive vacuum and thereafter heated to hundreds or thousands of degrees. Once the process is complete, the furnace must cool prior to opening and removing the treated materials and parts. This cooling process is often very time consuming and in many cases may takes hours, days or weeks.

Certain types of newer induction furnaces or susceptor systems provide gas cooling systems in various forms for use with induction systems including vacuum chambers and/or steel walled vessels. In these systems, the heat exchange medium is gas that is either re-circulated across an inner water cooled wall surface or forced outside the chamber through a heat exchanger.

However, many induction heated susceptor systems are designed without vacuum chambers and/or steel walled vessels. These systems are still in use and continue to be supplied as new and operate where they provide desirable processing of parts; however its users desire to reduce the time required for cool down to a temperature where the furnace may be disassembled or otherwise opened so that unloading and handling of the finished materials and parts may occur. As noted above, often this cooling time is hours or days, and in some cases may take a week or longer. An accelerated or more rapid cooling is desired but must be accomplished without opening the system to the atmospheric air as such opening prior to proper and complete cooling to the oxidation temperature or below may cause metallurgical, chemical or oxidation of the product or susceptor.

The alternatives of using a "once through" inert gas flow takes excessively long and results in significant capture costs where done properly to be environmentally safe. In most instances, venting of the inert gas is illegal so this is not an option.

It is thus very desirable to discover a method of accelerated cooling for use with the many induction heated susceptor systems that were designed without vacuum chambers and/or steel walled vessels.

BRIEF SUMMARY OF THE INVENTION

The present invention is a method and apparatus for accelerated cooling of a heating system such as a susceptor heating system.

Specifically, the invention includes a heat chamber, a cooling gas circulator fluidly connected to the heat chamber for providing a first portion of cooling gas thereto, a bypass whereby a second portion of the cooling gas bypasses the heat chamber and is merged back in with the first portion of the cooling gas that was provided to the heat chamber after the first portion has exited the heat chamber, and a heat exchanger for removing heat from the cooling gas after the first portion has exited the heat chamber and prior to re-circulating of the cooling gas into the cooling gas circulator.

The present invention is also a method for accelerated cooling of a furnace, the method including the steps of circulating a first portion of cooling gas to a heat chamber after heating of the heat chamber has been completed, bypassing a second portion of the cooling gas around the heat chamber, merging the first portion of the cooling gas that was provided to the heat chamber with the second portion of cooling gas that bypassed the heat chamber, and removing heat from the cooling gas after merging the first portion that has exited the heat chamber with the second portion that bypassed the heat chamber.

The foregoing advantages, construction and operation of the present invention will become more readily apparent from the following description and the accompanying drawings.

BRIEF DESCRIPTION OF THE SEVERAL VIEWS OF THE DRAWINGS

Preferred embodiments of the invention, illustrative of the best modes in which the applicant has contemplated applying the principles, are set forth in the following description and are shown in the drawings and are particularly and distinctly pointed out and set forth in the appended claims.

FIG. 3 shows cooling gas flow through the susceptor;

Similar numerals refer to similar parts throughout the drawings.

DETAILED DESCRIPTION OF THE INVENTION

Figure 1:
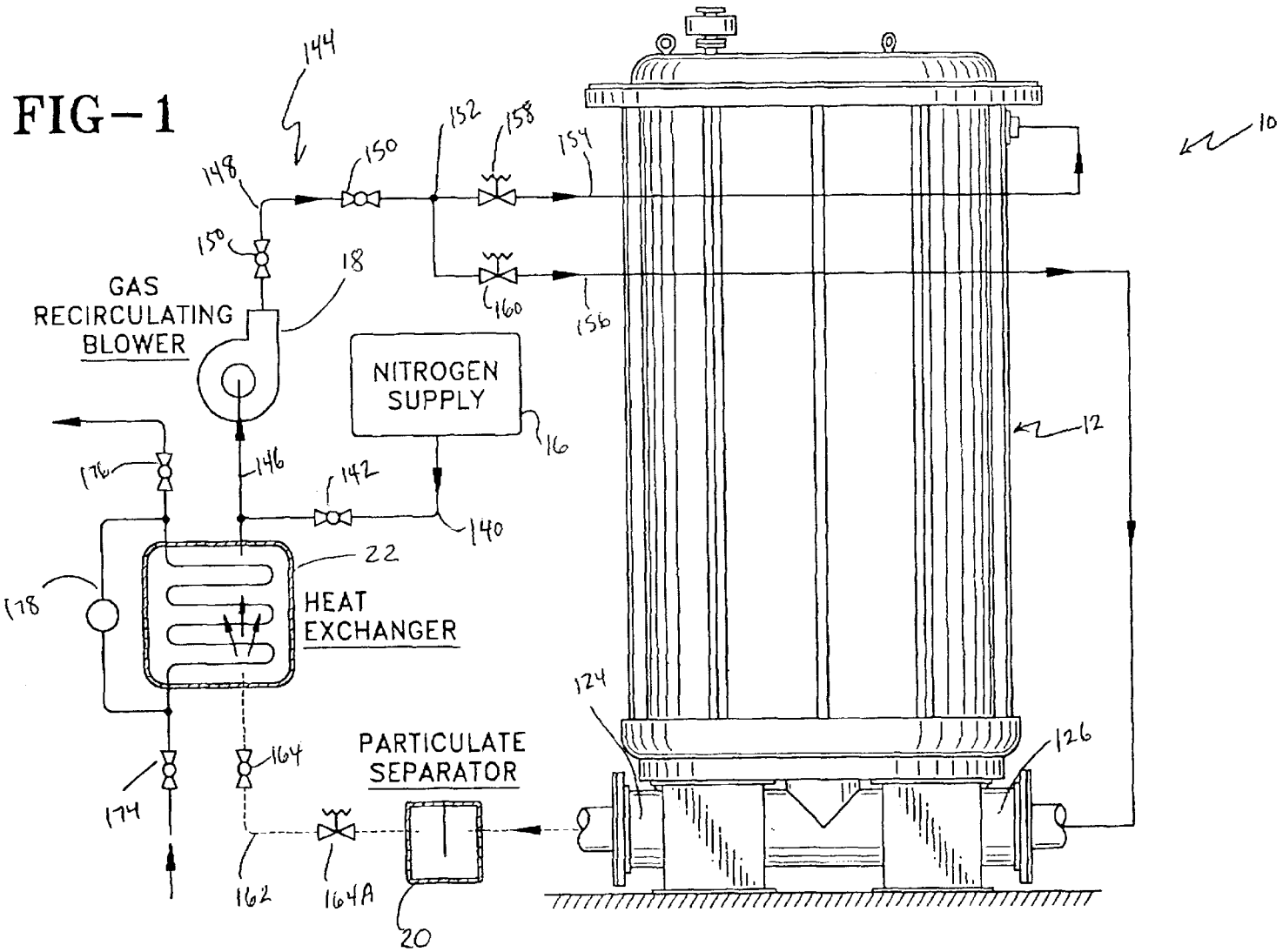
FIG. 1 is a front elevational view of a first embodiment of a susceptor heating system that provides for accelerated cooling.

The invention as is shown in FIG. 1 is an improved heating system 10, and method of use thereof, for accelerated cooling of the system and chambers therein. The system 10 includes a heating body 12 with a susceptor body or carrier 14 selectively insertable therein for carrying items 200 to be heated, a cooling gas supply 16, a gas circulator 18, a particulate separator 20, a heat exchanger 22, and various fluid piping, connectors and valves as described in more detail below.

Figure 2:
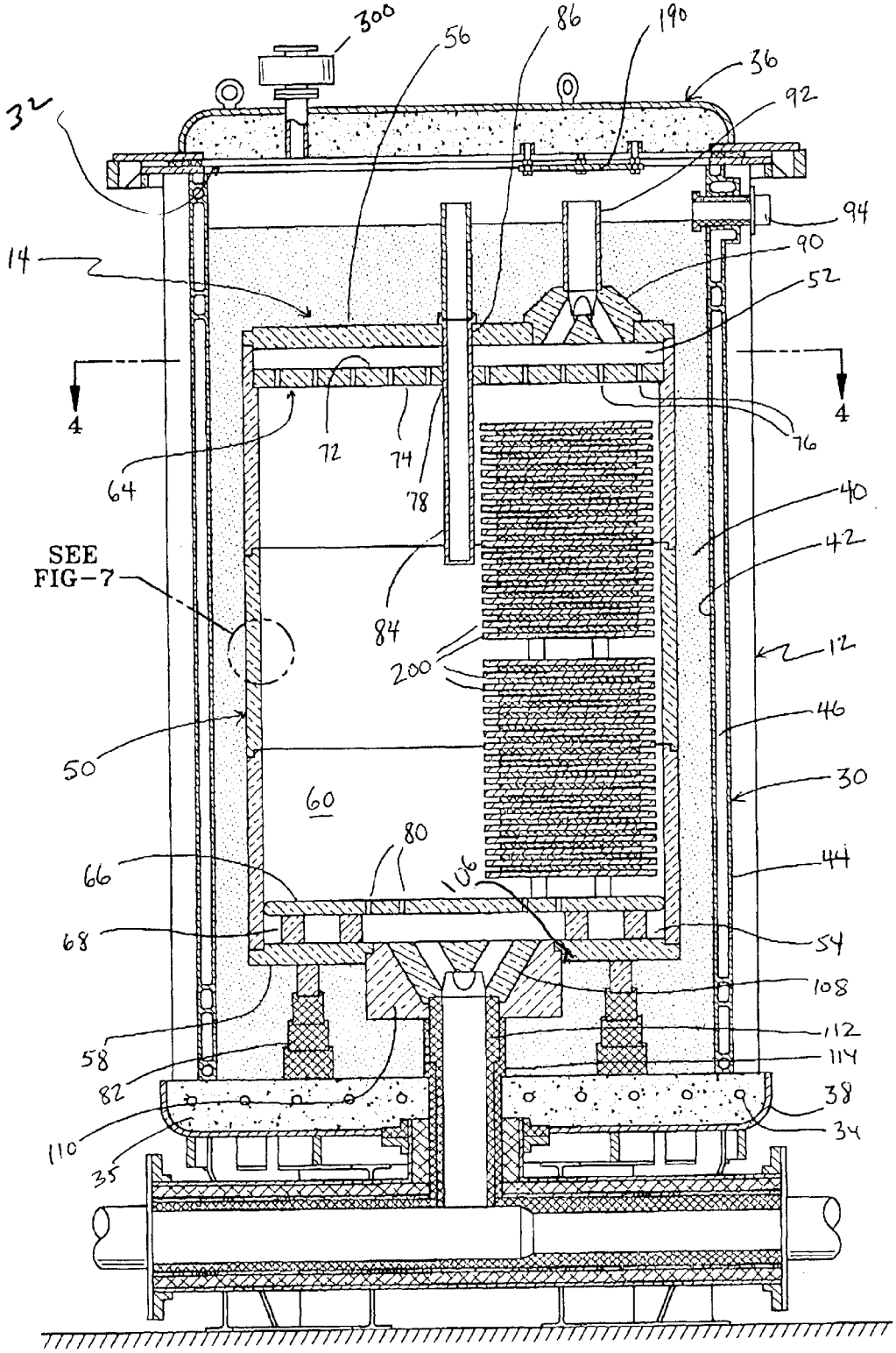
FIG. 2 is a sectional view of the susceptor portion of the heating system.

Heating body 12 as best shown in FIGS. 1–2 in one embodiment includes a generally cylindrical outer shell 30 with an open top end 32, a cover 36 selectively covering the top end 32, and a bottom end 38, whereby the combination of which define a main chamber 40 having an inner surface and an outer surface. The shell 30, cover 36 and end 38 are designed as is well known in the art. Shell 30 in the embodiment shown is a multiple wall design with an inner wall 42 defining the inner surface, an outer wall 44 defining the outer surface, and with an insulating chamber 46 therebetween whereby elongated ribs extend from the outer wall for structural support. Cover 36 is any cover capable of selectively sealing the top end while also being removable to allow for access to the chamber 40, whereby the cover typically includes hooks or other mechanisms to assist in the lifting of the lid from the shell, and seals or other arrangements for sealing the cover onto the shell as is needed during heating. Various vents, pressure relief valves and/or other devices as are well known in the art are also often present.

The shell 30 and/or end 38 may includes an induction heating coil and insulating materials to thermally protect the coil from the hot susceptor where required. In the embodiment shown, the coil is positioned within space 46 that is positioned within the shell while the base 38 includes fluid passages 34 with insulation 35 therearound.

The cover 36 includes a lip around its perimeter which serves as a flame deflector. The cover also has a seal for sealing it to the shell; in the preferred embodiment, the cover and seal are designed such that extreme pressure is relieved by the cover lifting slightly, allowing pressure relief, and then re-seating in a sealed manner.

Figure 7:
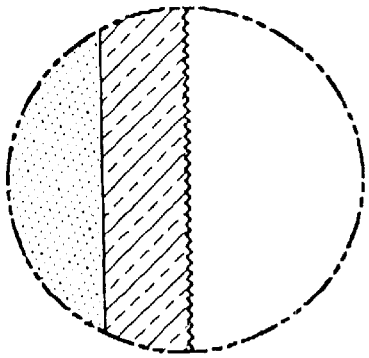
FIG. 7 is a detailed sectional view of the inner wall of the inner chamber of the susceptor taken from FIG. 2.
Figure 8:
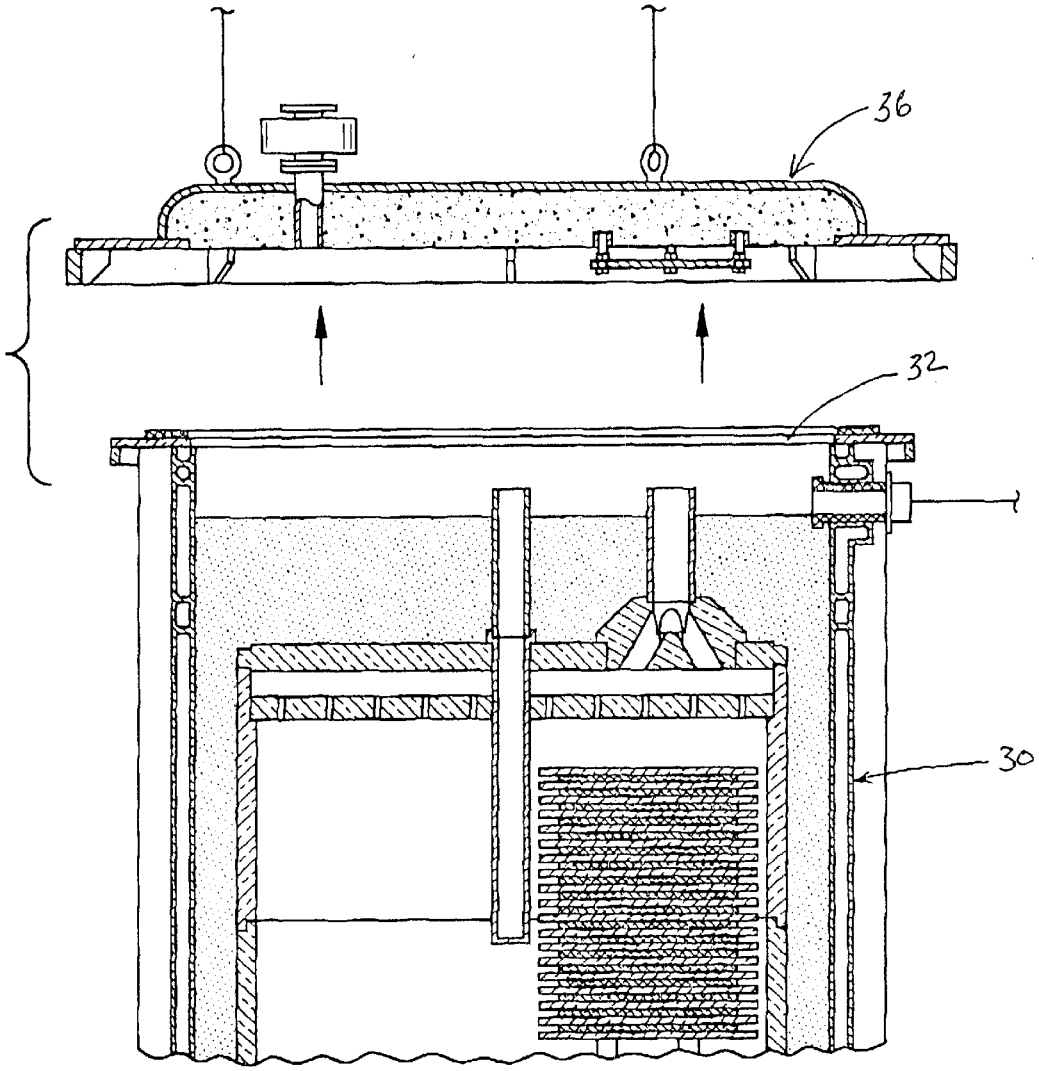
FIG. 8 is a partial sectional view similar to FIG. 2 except that the susceptor lid is being removed.

The susceptor body 14 is best shown in FIGS. 1–2 to include a main body 50 having an open top area 52 and an open bottom area 54, a lid 56 for selectively closing the top area, and a bottom plate or bottom 58 for closing off the bottom area, whereby the combination of which defines a susceptor chamber 60 which in the preferred embodiment has a rough or serrated surface as best shown by FIG. 7 to provide for gas turbulence in the chamber. Within the susceptor body 14 is a diffuser plate 64 proximate the top area 52, and a base plate 66 proximate the bottom end 54 where the base plate includes a plurality of feet 68, where each of the diffuser and base plates extends completely across the susceptor chamber 60. The diffuser plate 64 includes top face 72 and a bottom face 74, and is generally arranged within the chamber 60 such that it is parallel with the lid 56, the base plate 66 and the bottom plate 58. The area between the diffuser plate 64 and the base plate 66 is the carrier chamber 65 where the items 200 to be heated are positioned.

Figure 3:
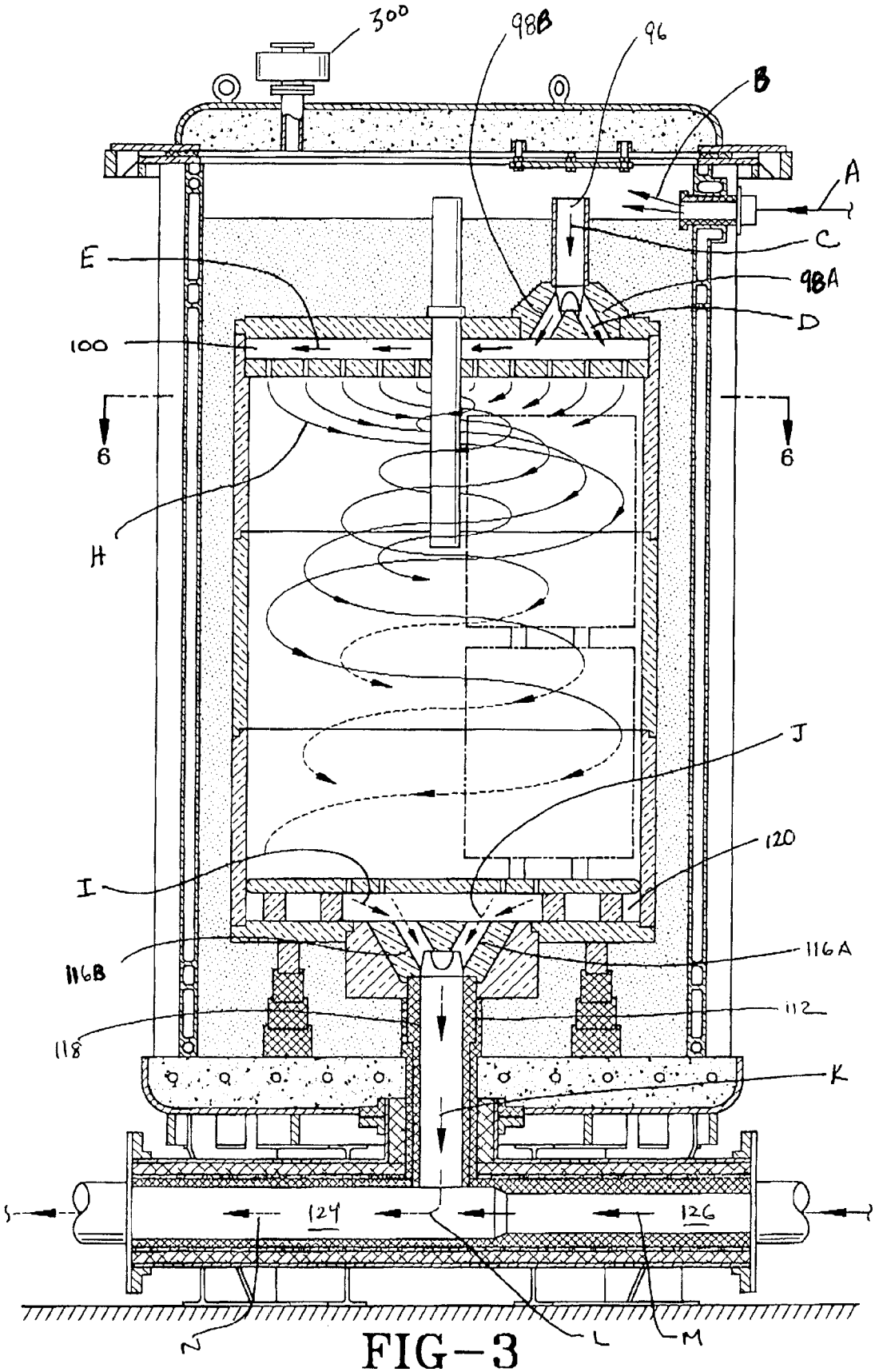
FIG. 3 is the same sectional view as FIG. 2 except
Figure 4:
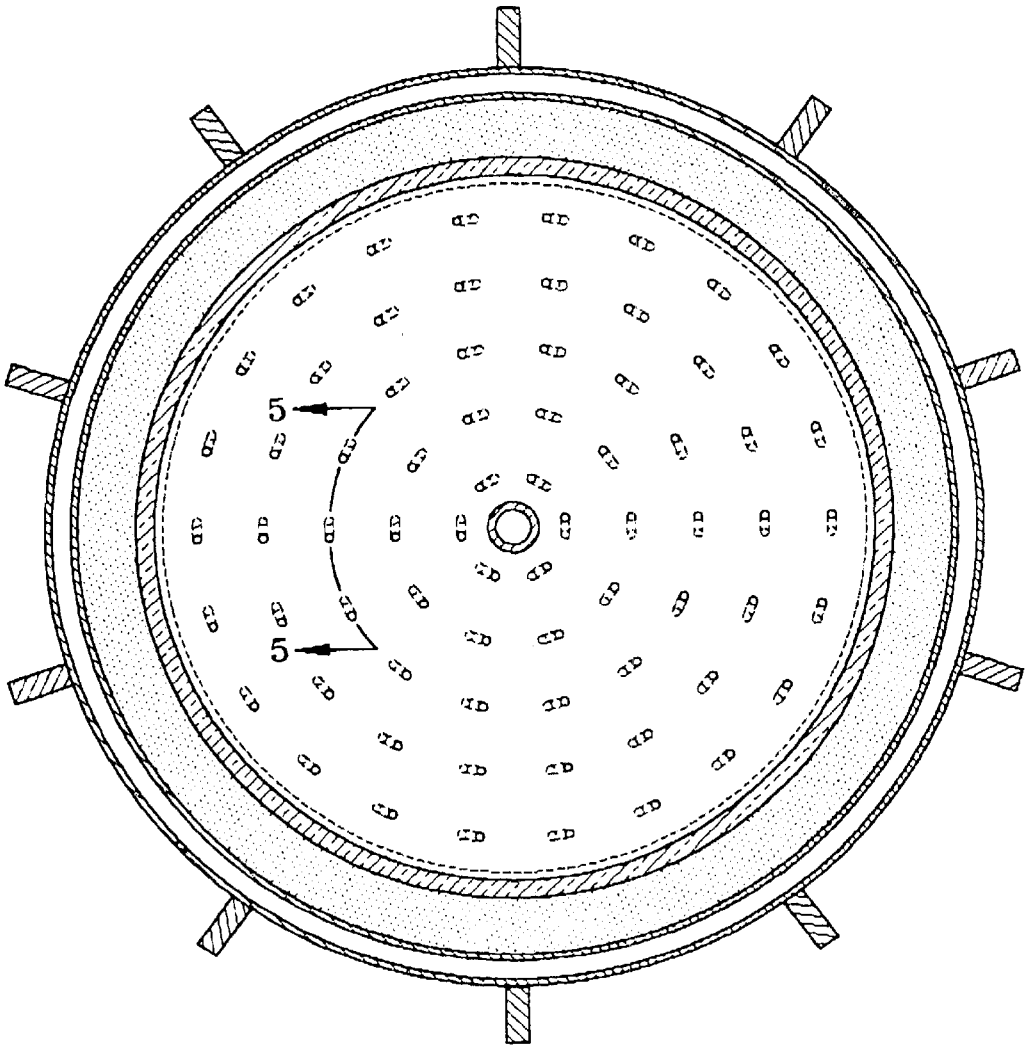
FIG. 4 is a sectional view of the base plate of the susceptor taken along lines 4—4 in FIG. 2.
Figure 5:
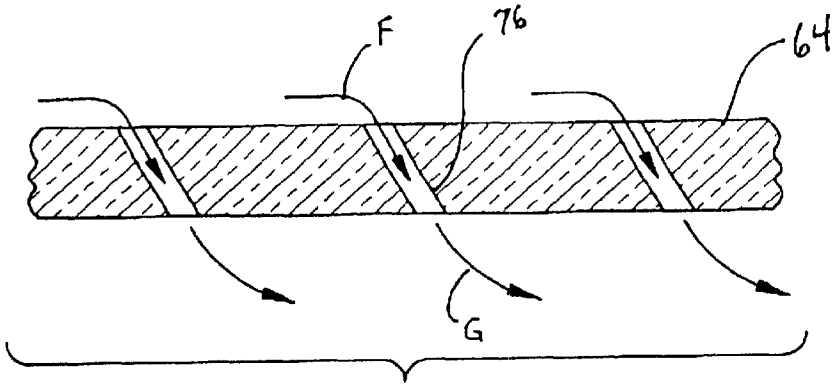
FIG. 5 is a detailed angular sectional view taken along line 5—5 in FIG. 4.
Figure 6:
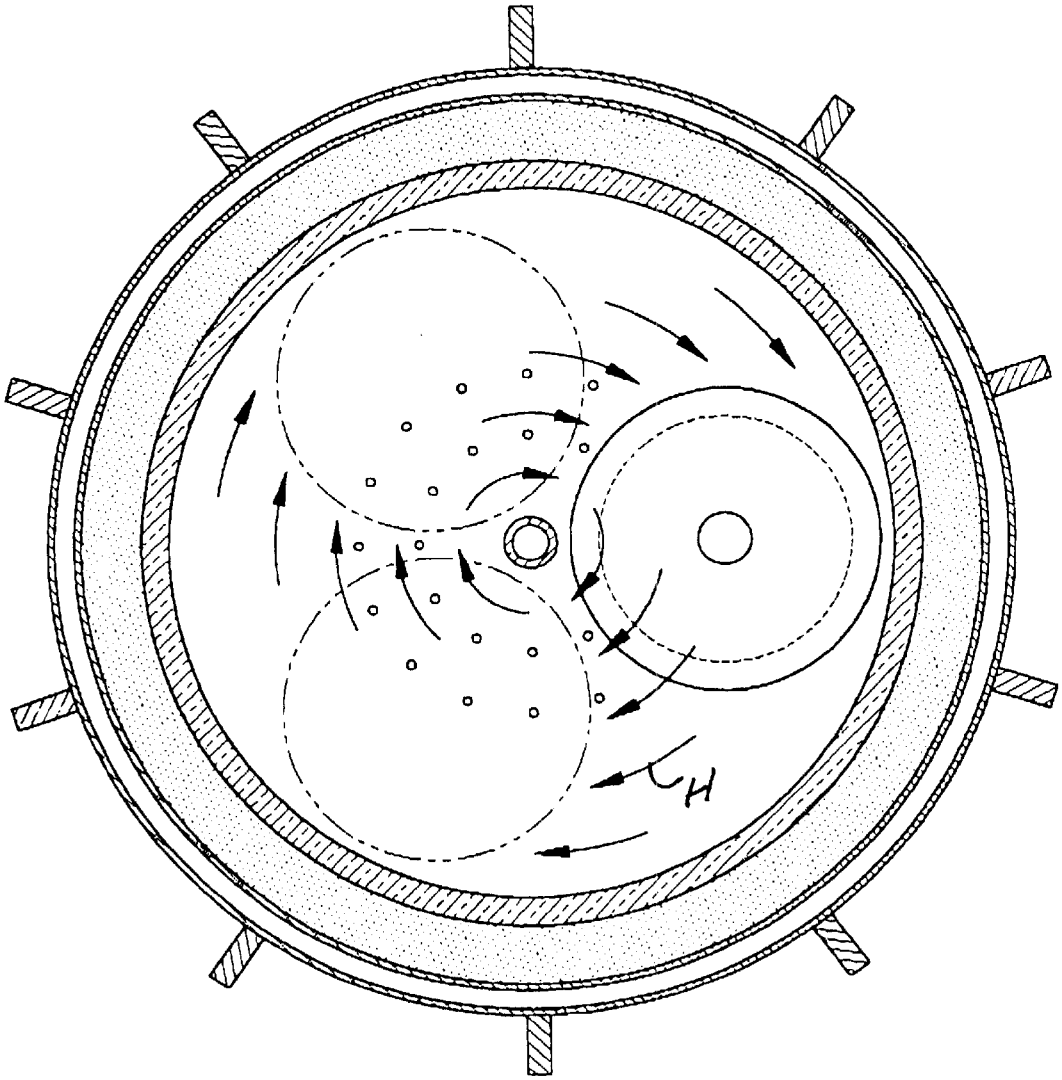
FIG. 6 is a sectional view of the inner chamber of the susceptor taken along line 6—6 in FIG. 3.

The diffuser plate also includes a plurality of diffuser holes 76 as best shown in FIGS. 2–5 where in one embodiment each of these holes is angular from the top face 72 to the bottom face 74, that is diagonal and not perpendicular to the top or bottom faces 72 and 74, respectively. This diagonal pattern is best shown in the cross sectional view of FIG. 5. In addition in a preferred embodiment, the plurality of diffuser holes 76 are arranged about a center hole 78 therein, the arrangement as best shown in FIG. 4 being of a multiple row design where each row is annular about the center hole 78. The base plate 66 also includes a plurality of holes 80 whereby these holes may be perpendicular through the base plate 66, or alternatively may be angular as described above on diffuser plate 64. These holes are placed to best collect gases from chamber and direct them to exit therefrom.

In one design, the main body 50 is more than one piece as shown in FIG. 2 where it is three pieces, namely an upper wall section 50A, a middle wall section 50B and a lower wall section 50C. Feet 82 support the main body 50 on the base 38.

Also within the susceptor body 14 is a temperature tube 84 that extends from inside to outside of the susceptor body via temperature tube hole 78 in the diffuser plate. 64 and a second temperature tube hole 86 in the lid 56, whereby in one embodiment the holes are axially aligned with a central axis in the generally cylindrical susceptor body 14. This temperature sight tube bay be at an angle to the vertical.

The lid 56 further includes an offset aperture 88 in which an entrance deflector 90 and entrance tube 92 are seated. The entrance tube 92 provides cooling gas entry into the susceptor chamber 60 from the main chamber 40 which is fed the cooling gas via an entry valve, inlet port or other like device 94. The entrance deflector 92 receives the entrance tube 90 with its internal passage 96 and branches or "Y"s into a pair of angled entrance passages 98A and 98B. The passages 98A and 98B empty into an upper plenum area 100 defined as the space between the lid 56 and the diffuser plate 64. The angled passages 98A and 98B eliminate a direct radiation path to the cover. The angle may also assist in swirl effect of fluid as described below.

The bottom plate 58 includes a centered bottom aperture 106 in which an exit deflector 108 is seated within an exit seat 110. The exit deflector is aligned with and in fluid communication with exit tube 112 which seats within exit tube sleeve 114. The exit deflector 108 provides multiple exit passages, for example as shown as 116A and 116B that merge together to align with an internal passage 118 within the exit tube 112 such that fluid within the lower plenum area 120, defined as the space between the base plate 66 and the bottom plate 58, fluidly connects to the passages 116A and 116B, the internal passage 118 and a mixing tube 124. The angled exit passages assist in decelerating fluid flow and eliminate direct path of radiation to base.

Cool gas tube 126 also fluidly connects to the mixing tube 124. Typically cool gas tube 126 and internal passage 118 are of a smaller diameter than mixing tube 124.

In addition to the heating body 12 with susceptor body 14 selectively insertable therein, the system 10 includes the cooling gas supply 16 which is any form of a tank or other supply device for supplying fluid for cooling the susceptor body. In one embodiment, the cooling gas supply is a nitrogen supply or tank as is shown in FIG. 1.

The gas supply 16 is connected via a conduit, pipe, or other passage 140, with a shut off valve 142 therein, to a main section 146 of a main fluid loop 144. Within main fluid loop 144 are the following components: the gas circulator 18 which is typically some form of a blower or gas/fluid accelerator, a blower-splitter conduit section 148,at least one valve 150 within the section 148 where the valve may be a shut off, one way or pressure relief type, a "Y" conduit section 152, a cooling conduit section 154 connecting the "Y" to valve 94, a bypass conduit section 156 connecting the "Y" to the cool gas tube 126, at least one valve 158 and 160 in each of the sections 154 and 156, respectively, where each valve may be a shut off, one way or pressure relief type, the cool gas tube 126, the mixing tube 124, the particulate separator 20, a separator exchanger conduit section 162, at least one valve 164 within the section 158 where the valve may be a shut off, one way or pressure relief type, and the heat exchanger 22.

The heat exchanger 22 provides for convective or conductive heat exchange from the main fluid loop 144 to a secondary fluid loop 170. This loop removes heat via conduction or convection within the heat exchanger from the main fluid loop 144 and removes or disposes of it. Typically, the loop 170 has an intake valve 174 and an outtake valve 176, as well as a bypass 178. Typically, within the heat exchanger, the cooling gas passes by coils 180 which are part of the secondary fluid loop 170.

The system further includes the following features. A high temperature heat shield 190 on the cover 36 above the tube 92 to protect the cover from heat escaping from the tube.

The entire system is under a slight positive pressure such that any leaks result in an outward flow. This protects the system from contamination by oxygen which causes oxidation of parts in process.

The process or method of using this system 10 is described as follows. As is well known in the art, items 200 to be heated for any of a variety of reasons such as heat treating, annealing, curing, baking on coatings, masking, tempering, or hardening are placed within the chamber 60, typically on racks or other storage devices. This is within the susceptor. The cover 36 is sealed onto the heating body 12. The system is heated via the induction-heating coil to hundreds or thousands of degrees. In accordance with the invention, once the heating process is complete, the exhaust valves are closed. Also, any purge gas or sweep gas are turned off. Temperature monitoring occurs until the temperature is below a preselected limit, such as 3200 degrees Fahrenheit, whereby the chamber inlet valve 158, the chamber outlet valve 164A, and the bypass valve 160 are opened. Thereafter, the blower 18 is turned on and slowly ramps up to full velocity. During the ramping up, a sensor adjacent to the valve 158 monitors the inlet flow rate of cooling gas to make sure the flow does not exceed a preset limit such as 500 CFM whereby if the flow rate does the valve 158 may be closed proportionally to lower the flow. Simultaneous with this flow, cooling fluid is bypassing the susceptor via conduit 156.

The ratio of cooling gas passing through the conduit 156 into the susceptor and the cooling gas bypassing the susceptor via conduit 154 is preferably varied throughout the cooling process. Initially, a majority of the cooling gas bypasses the susceptor, but then merges with the cooling gas that has cooled the susceptor by taking on heat, whereby the significantly higher bypassed cooling fluid better assists in cooling the heated cooling gas exiting from the susceptor. As the system cools, the ratio is adjusted until in the end, a majority of the cooling gas passes through the susceptor to cool the susceptor, but then merges with the cooling gas that has bypassed the susceptor, as very little additional cooling is needed prior to the heat exchanger due to the significant temperature drop that will have occurred by this time in the process.

In more detail, the system 10 has an induction-heating coil that is used to heat the susceptor and its contents. Insulating materials protect the coil from the hot susceptor. The susceptor is typically made of graphite, but need not be as it may be made of any electrically conductive material. The coil sets on a base assembly designed to allow the flow of gases out of the chamber 60 of the susceptor and the chamber 40 the susceptor sets in. This area is often referred to as the hot zone. When cooling is desired as described above, the cooling gas are propelled by the blower 18 through an inlet port 94 where the gases are directed into the furnace hot zone via the special passages, plenums, ports, etc. This is best shown in FIG. 3 where the gas is provided at the inlet port 94 as cooling gas A whereby it passes into the furnace as shown at B. The insulating material is shown as dotted shading in chamber 40. Due to the presence thereof, the cooling gas is directed into the internal passage 96 in entrance tube 92 as shown by arrow C and then directed angularly into the upper plenum area 100 by the pair of angled entrance passages 98A and 98B as shown by arrows D. The cooling gas travels through the plenum 100 as shown by arrows E. The cooling gas is the directed through the diffuser plate 64 via the plurality of diffuser holes 76 which are angled thus resulting in the cooling gas traveling as shown by arrows F and G in FIG. 5. This angular path causes the cooling gas to swirl as it enters the chamber 60 and passes the contents 200 therein. This swirling action is shown by the plurality of arrows H and it assists in creating maximum turbulence. The cooling gases are heated by convection, radiation and conduction with the susceptor and contents thereby cooling the susceptor and its contents, and thus creating heated cooling gas. The walls of the susceptor are typically graphite and preferably include imperfections or a roughened surface to assist in the creation of turbulence of the cooling gas whereby the turbulence maximizes heat transfer from the susceptor walls to the cooling gas. The strategically placed plurality of base plate holes 80 allow the swirling cooling gas to exit the chamber 60 and enter lower plenum 120 as shown by arrows 1. The cooling gas then is directed into the pair of angled exit passages 116A and 116B in exit deflector 108 as seated in exit seat 110 as shown by arrows J, and the fluidly connected internal passage 118 in exit tube 112 seated in exit tube sleeve 114 as shown by arrows K. This conveys the heated cooling gases out of the heating body 12 and susceptor 14 therein. It is conveyed from the exit tube 118 into the mixing tube 124 as shown by arrow L whereby non-heated cooling gas, typically traveling at a higher velocity, is provided by the cooling gas tube 126 as shown as arrow M to assist in rapid cooling of the heated cooling gas from the susceptor. The combined non-heated cooling gas from the cooling tube 126 and the heated cooling gas from the exit tube 118 are mixed so as to begin cooling by diluting the heated cooling gas, and conveyed to the optional particulate separator 20 and then the heat exchanger 22 where complete cooling of the cooling gas occurs. The particulate separator 20 is an optional step and device where any particles that are flowing with the cooling gas are collected and removed to eliminate any particulate erosion of the furnace/heating body, susceptor, contents being heated, etc. The cooling gas is then conveyed into the heat exchanger 22 whose exchange medium may be air, water or other medium that is typically preferably environmentally friendly versus the cooling gas medium with is often an inert gas such as argon or nitrogen. The exchange medium removes heat from the cooling gas such that the cooling gas may be propelled by the blower 18 so as to be re-circulated again through the system 10 for purposes of cooling the susceptor and its contents whereby this is continued until the susceptor is cooled to the desirable temperature where the susceptor and/or its contents may be safely removed from the furnace. As the re-circulation continues the ratio of cooling gas used to cool the susceptor versus bypassing the susceptor to dilute the heated cooling gas changes from a very low ratio, such as 5% or 10%, to a very high ratio, such as 90% or 95%. This assures that the cooling gas efficiently cools the susceptor and its contents while at the same time the heated cooling gas post-susceptor is also partially cooled prior to entrance into the particulate separator 20 and heat exchanger 22 to assure no damage is done to either due to excessive heat and to assure better efficiency of the heat exchanger in returning the cooling gas to its original cooling temperature prior to recirculation.

It is noted that the direction of the gas flow may be reversed with suitable re-orientation of the components of the system.

The cover is of a suitable design to contain the gases under high temperature and pressure with a suitable lift off feature to safely expel the gases should the pressure exceed safe limits while thereafter re-sealing upon re-seating of the cover. The cover also contains a special hot expulsion gas lift and rotate valve 300 which is motor actuated or pressure actuated at a preset pressure limit to avoid over-pressure within the furnace.

Accordingly, the improved system of the above embodiments is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved system is constructed and used, the characteristics of the construction, and the advantageous, new and useful results obtained; the new and useful structures, devices, elements, arrangements, parts and combinations, are set forth in the appended claims.

What is claimed is:

1. A system for accelerated cooling of a furnace, the system comprising:

a heat chamber;

a cooling gas circulator fluidly connected to the heat chamber for providing a first portion of cooling gas thereto;

a bypass whereby a second portion of the cooling gas bypasses the heat chamber and is merged back in with the first portion of the cooling gas that was provided to the heat chamber after the first portion has exited the heat chamber; and a heat exchanger for removing heat from the cooling gas after the first portion has exited the heat chamber and prior to re-circulating of the cooling gas into the cooling gas circulator.

2. The system of claim 1 further comprising a particulate separator for removing particles from the cooling gas after the first portion has exited the heat chamber.

3. The system of claim 1 further comprising means for swirling the first portion of cooling gas within the heat chamber.

4. The system of claim 3 wherein the heat chamber includes a carrier having a lid, at least one side and a bottom the combination defining an internal chamber in which items to be heated are positioned.

5. The system of claim 4 wherein the internal chamber further comprises a diffuser plate proximate yet separate from the lid so as to define an upper plenum area between the diffuser plate and the lid, and a base plate proximate yet separate from the bottom so as to define a lower plenum area between the base plate and the bottom.

6. The system of claim 5 wherein the diffuser plate includes a plurality of diffuser holes, and the base plate includes a plurality of base holes.

7. The system of claim 6 wherein the diffuser holes are arranged annularly around a center point in the diffuser plate.

8. The system of claim 7 wherein the diffuser holes are angled through the diffuser plate.

9. The system of claim 6 wherein the diffuser holes are arranged in multiple rows annularly around a center point in the diffuser plate, and wherein the diffuser holes are angled through the diffuser plate.

10. The system of claim 9 wherein the lid includes an entrance tube through which the cooling gas flows into the upper plenum area whereby the entrance tube includes a portion thereof that branches into multiple paths that are angled, and an exit tube through which the cooling gas flows out of the lower plenum area whereby the exit tube includes a portion thereof that branches into multiple paths that are angled.

11. The system of claim 4 wherein the at least one side is one of roughened, serrated, and uneven to provide turbulence.

12. The system of claim 4 wherein the ratio increases during the cooling process.

13. The system of claim 1 wherein a ratio of the first portion of cooling gas to the second portion of cooling gas varies during the cooling process.

14. A system for accelerated cooling of a furnace, the system comprising:

a heat chamber;

a cooling loop having a cooling gas circulator fluidly connected thereto;

a bypass for bypassing a portion of the cooling gas in the cooling loop around the heat chamber and merging it back in with the cooling gas that was provided to the heat chamber after the heat chamber; and a heat exchanger for removing heat out of the cooling.

15. The system of claim 14 further comprising means for swirling the cooling gas within the heat chamber.

16. The system of claim 15 wherein the heat chamber includes a carrier having a lid, at least one side and a bottom the combination defining an internal chamber in which items to be heated are positioned, and the internal chamber further comprises a diffuser plate proximate yet separate from the lid so as to define an upper plenum area between the diffuser plate and the lid, and a base plate proximate yet separate from the bottom so as to define a lower plenum area between the base plate and the bottom.

17. The system of claim 15 wherein the diffuser plate includes a plurality of diffuser holes that are both arranged in multiple rows annularly around a center point in the diffuser plate and are angled through the diffuser plate, and the base plate includes a plurality of base holes.

18. A method for accelerated cooling of a furnace, the method comprising:

circulating a first portion of cooling gas to a heat chamber after heating of the heat chamber has been completed;

bypassing a second portion of the cooling gas around the heat chamber;

merging the first portion of the cooling gas that was provided to the heat chamber with the second portion of cooling gas that bypassed the heat chamber; and removing heat from the cooling gas after merging the first portion that has exited the heat chamber with the second portion that bypassed the heat chamber.

19. The method of claim 18 wherein the circulating of the first portion further includes swirling of the first portion within the heat chamber.

20. The method of claim 18 further comprising the step of altering a ratio to the first portion to the second portion throughout the cooling process.

* * * * *